US006558199B2

(12) United States Patent
Oguchi

(10) Patent No.: US 6,558,199 B2
(45) Date of Patent: May 6, 2003

(54) CONNECTOR DEVICE FOR CARD WITH A PLURALITY OF CONNECTION TERMINALS DIFFERENT IN LENGTH

(75) Inventor: Wataru Oguchi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/886,316

(22) Filed: Jun. 19, 2001

(65) Prior Publication Data

US 2002/0009928 A1 Jan. 24, 2002

(30) Foreign Application Priority Data

Jul. 6, 2000 (JP) ..... 2000-210698

(51) Int. Cl.[7] ..... H01R 24/00
(52) U.S. Cl. ..... 439/630; 439/910; 439/924.1
(58) Field of Search ..... 439/630, 60, 924.1, 439/607, 637

(56) References Cited

U.S. PATENT DOCUMENTS

| | | | | |
|---|---|---|---|---|
| 4,298,237 A | * | 11/1981 | Griffith et al. | 439/60 |
| 4,349,237 A | * | 9/1982 | Cobaugh et al. | 439/637 |
| 5,207,598 A | * | 5/1993 | Yamada et al. | 439/636 |
| 5,269,707 A | | 12/1993 | Reichardt et al. | 439/630 |
| 5,395,259 A | | 3/1995 | Casses | 439/188 |
| 5,478,259 A | * | 12/1995 | Noschese | 439/607 |
| 5,586,890 A | * | 12/1996 | Braun | 439/630 |
| 5,775,929 A | | 7/1998 | Hashiguchi | 439/260 |
| 6,017,231 A | | 1/2000 | Yoshitsugu et al. | 439/159 |
| 6,045,049 A | | 4/2000 | Nishimura et al. | 235/486 |

FOREIGN PATENT DOCUMENTS

| | | |
|---|---|---|
| DE | 100 46 638 A1 | 5/2001 |
| EP | 0 883 084 A2 | 12/1998 |
| EP | 0908981 A2 | 4/1999 |
| WO | WO 0135333 A | 5/2001 |

OTHER PUBLICATIONS

European Search Report, dated Jul. 31, 2002.
European Search Report, dated Oct. 22, 2001.

* cited by examiner

*Primary Examiner*—Javaid Nasri
(74) *Attorney, Agent, or Firm*—Beyer Weaver & Thomas, LLP

(57) ABSTRACT

According to the present invention, provided is a card connector device in which supporting positions of the individual connection terminals with respect to a header are formed on a straight line without being shifted forward and backward and rigidity of the respective supporting portions of the individual connection terminals increases as the length to the contact portion increases, so that the contact pressure of the respective connection terminals is uniform and the miniaturization of the whole connector device can be accomplished. The card connector device comprises a header provided side by side with a plurality of connection terminals made of electrically conductive metal plate; and a frame, at one end of which the header is arranged and into which is fitted a card with a plurality of contacts capable of being connected to the connection terminals, wherein the connection terminals are provided with a supporting portion supported by the header and a contact portion elastically contacted with the corresponding contact of the card at a free end extended from the supporting portion, and wherein the connection terminals are formed so that the supporting portions are positioned side by side on a same straight line having a direction perpendicular to a card-inserting direction. The length from the supporting portions to the contact portions differs and, at the same time, as the length from the supporting portion to the contact portion increases, rigidity of the supporting portion increases.

9 Claims, 8 Drawing Sheets

CONNECTOR DEVICE FOR CARD WITH A PLURALITY OF CONNECTION TERMINALS DIFFERENT IN LENGTH

BACKGROUND OF THE INVENTION

1. Field of the Invention

The present invention relates to a card connector device utilized with an Integrated Circuit (IC) card used, for example, as a memory medium in a personal computer or with a Multi Media Card (MMC) used in electronic equipment and the like such as a digital camera.

2. Description of the Related Art

IC card connector devices are generally used as a recording device additionally installed in personal computers and the like. The IC card has been widely used as the memory medium of an IC card connector device.

The IC card is fitted into the IC card connector device to carry out the writing and reading of necessary information. A plurality of contacts are provided in the IC card and a header in the IC card connector device is provided with connection terminals having a plurality of contact portions corresponding to arrangement positions of the plurality of contacts provided in the IC card. Also, in the header, a plurality of solder portions soldered to a circuit pattern portion of a circuit board to which the IC card connector device is adhered, are formed and projected, and the contact portions and the respective solder portions become electrically connected within the header.

Also, among IC cards, there are IC cards in which, in order to prevent the destruction of an internal IC circuit of the IC card due to an inrush current and the like when being connected to connection terminals, a connection sequence with the corresponding connection terminals is prescribed. In general, a method for prescribing the connection sequence is carried out by differing the positions where the contact portions of the connection terminals on the IC card connector device connect with the corresponding contacts on the IC card.

In order to differ the connecting positions of the contact portions of the connection terminals with the corresponding contacts on the IC card, respective positions of the connection terminals with respect to the header on the IC card connector are suitably shifted forward and backward in the IC card-inserting direction.

However, in the structure of the header of the conventional IC card connector device described above, there is a problem in that the length of the supporting portion of the connection terminal of the header increases due to this forward and backward shifting of the connection terminals in the IC card inserting direction. Thus, miniaturization of the whole connector device cannot be accomplished.

Also, in order to adjust the positions of the respective connection terminals without shifting forward and backward, there is a method of differing the lengths from the supporting portions of the connection terminals to the contact portions. But this method has a problem in that contact pressures on the contacts of the IC card can change according to the lengths from the supporting portions of the connection terminals.

Therefore, the present invention is made in order to solve the above problems, and thus an object of the present invention is to provide a card connector device in which supporting positions of the plurality of connection terminals with respect to the header are formed on the same straight line without being shifted forward and backward and in which the rigidity of the respective supporting portions increases as the length from the supporting portions of the connection terminals gets longer, so that the contact pressures of the connection terminals are uniform and miniaturization of the whole connector device can be accomplished.

SUMMARY OF THE INVENTION

In a first means for solving the above problems according to the present invention, a card connector device comprises: a header provided side by side with a plurality of connection terminals made of electrically conductive metal plate; and a frame in which the header is arranged at one end thereof and into which is fitted a card with a plurality of contacts capable of electrical connection to corresponding connection terminals. The connection terminals are provided with a supporting portion supported by the header and a contact portion elastically contacted with corresponding contacts of the card at a free end extended from the supporting portion, wherein the connection terminals are formed so that the supporting portions are positioned side by side on a straight line in the direction perpendicular to a card-inserting direction. The lengths from the supporting portions to the contact portions differ and, at the same time, as the length from the supporting portion to the contact portion increases, the rigidity of the supporting portion increases.

Also, in a second means according to the present invention, the connection terminals are formed so that the supporting portions are positioned side by side on a straight line in a direction perpendicular to a card-inserting direction. The lengths from said supporting portions to contact portions differ and at the same time, as the length from the supporting portion to the contact portion increases, the width of the supporting portion increases.

Also, in a third means according to the present invention, the header is arranged at a front end in the card-inserting direction of the frame and the connection terminals are provided with solder portions which are projected from the front side of the header to be soldered to a circuit board.

Also, in a fourth means according to the present invention, the connection terminals are integrally molded in the header through the supporting portions.

BRIEF DESCRIPTION OF THE DRAWINGS

The above objects, other objects, features and advantages of the present invention will be better understood from the following description taken in conjunction with the accompanying drawings, in which.

DETAILED DESCRIPTION OF THE PREFERRED EMBODIMENT

Figure 1:
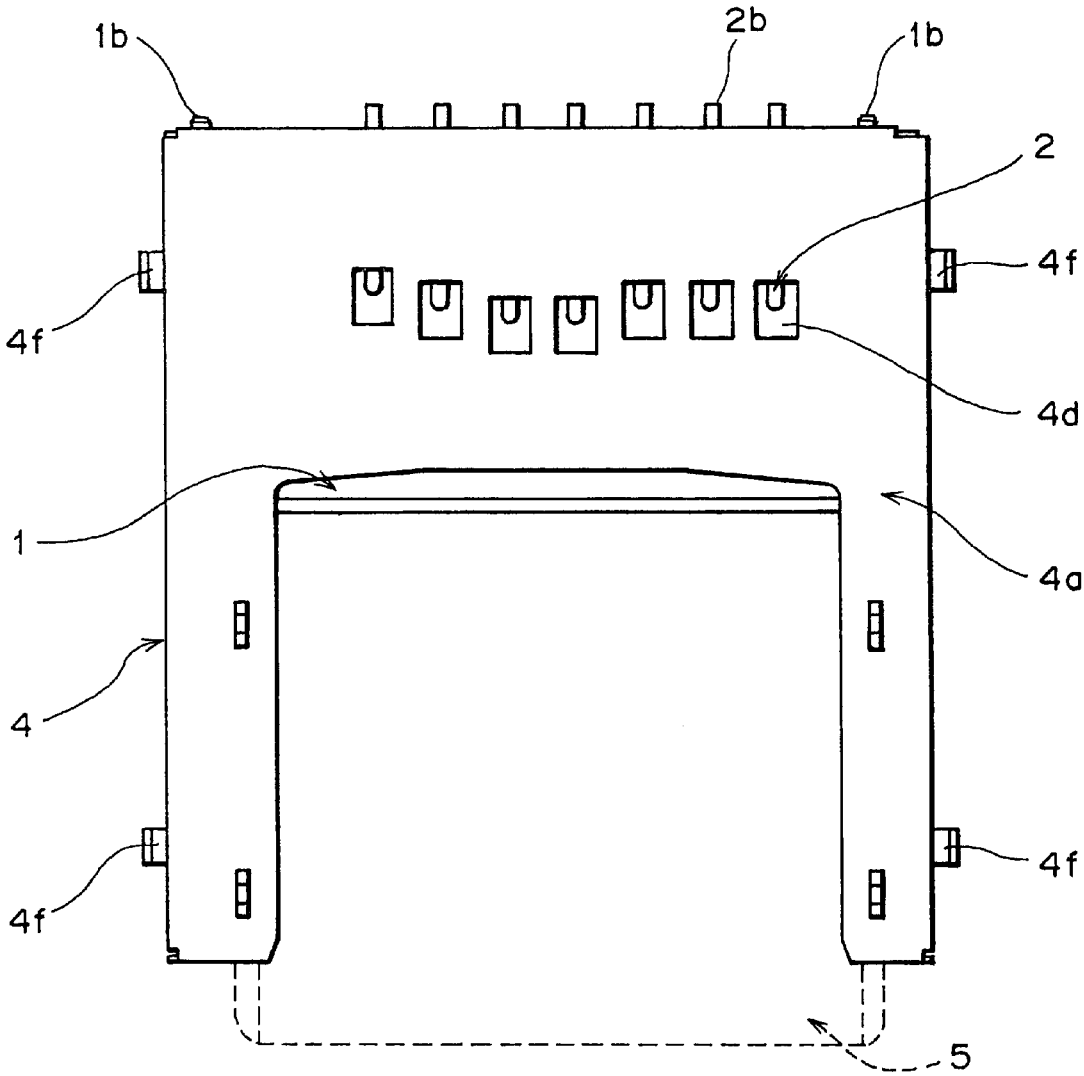
FIG. 1 is a plan view showing a card connector device according to an embodiment of the present invention.
Figure 2:
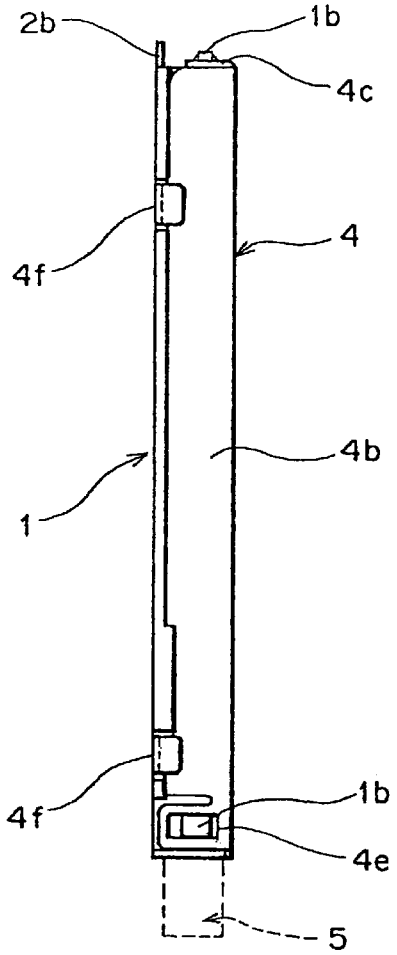
FIG. 2 is a side view showing the card connector device according to an embodiment of the present invention.
Figure 3:
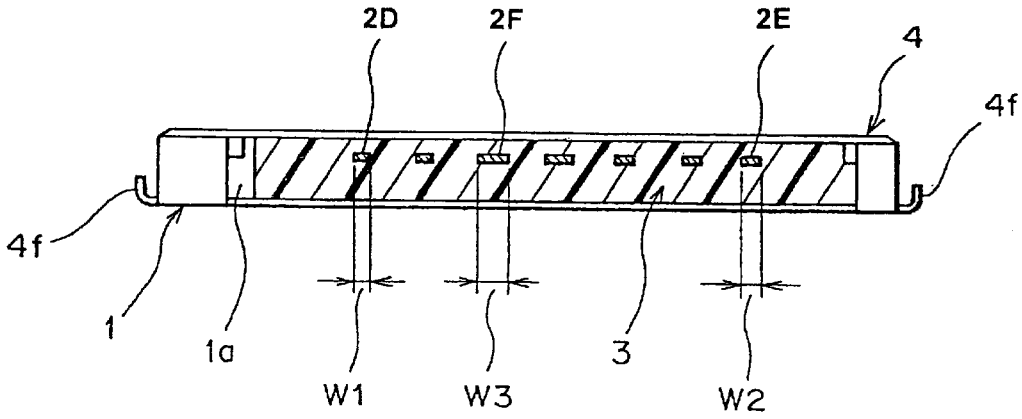
FIG. 3 is a front view showing the card connector device according to an embodiment the present invention.
Figure 4:
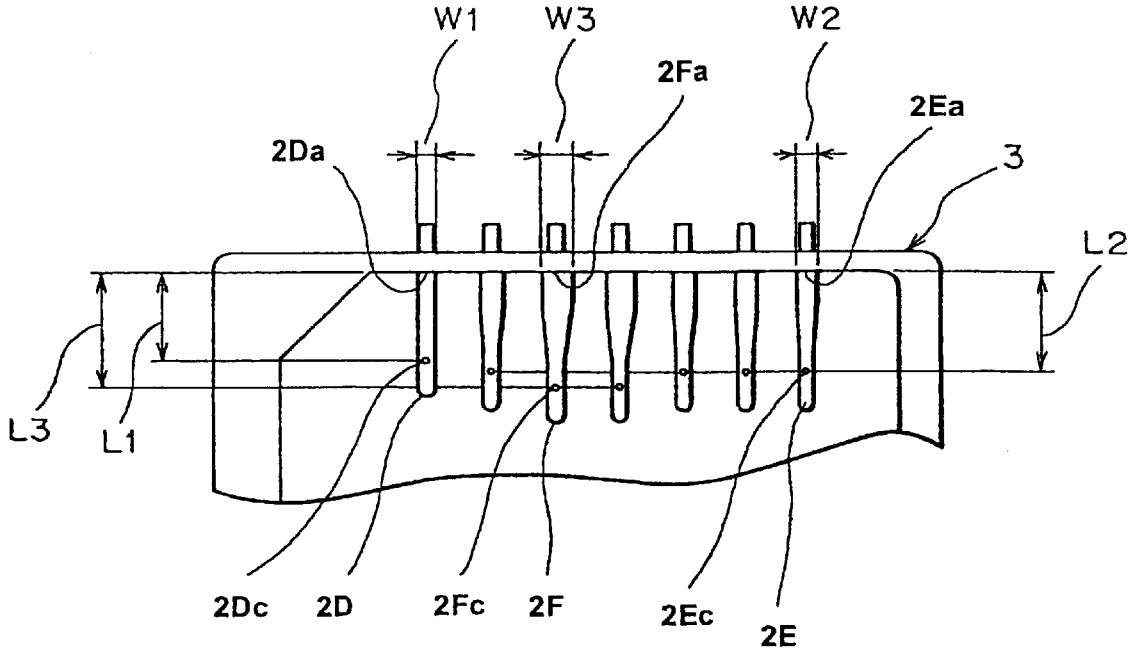
FIG. 4 is a partial plan view showing a header of the card connector device according to an embodiment of the present invention.
Figure 5:
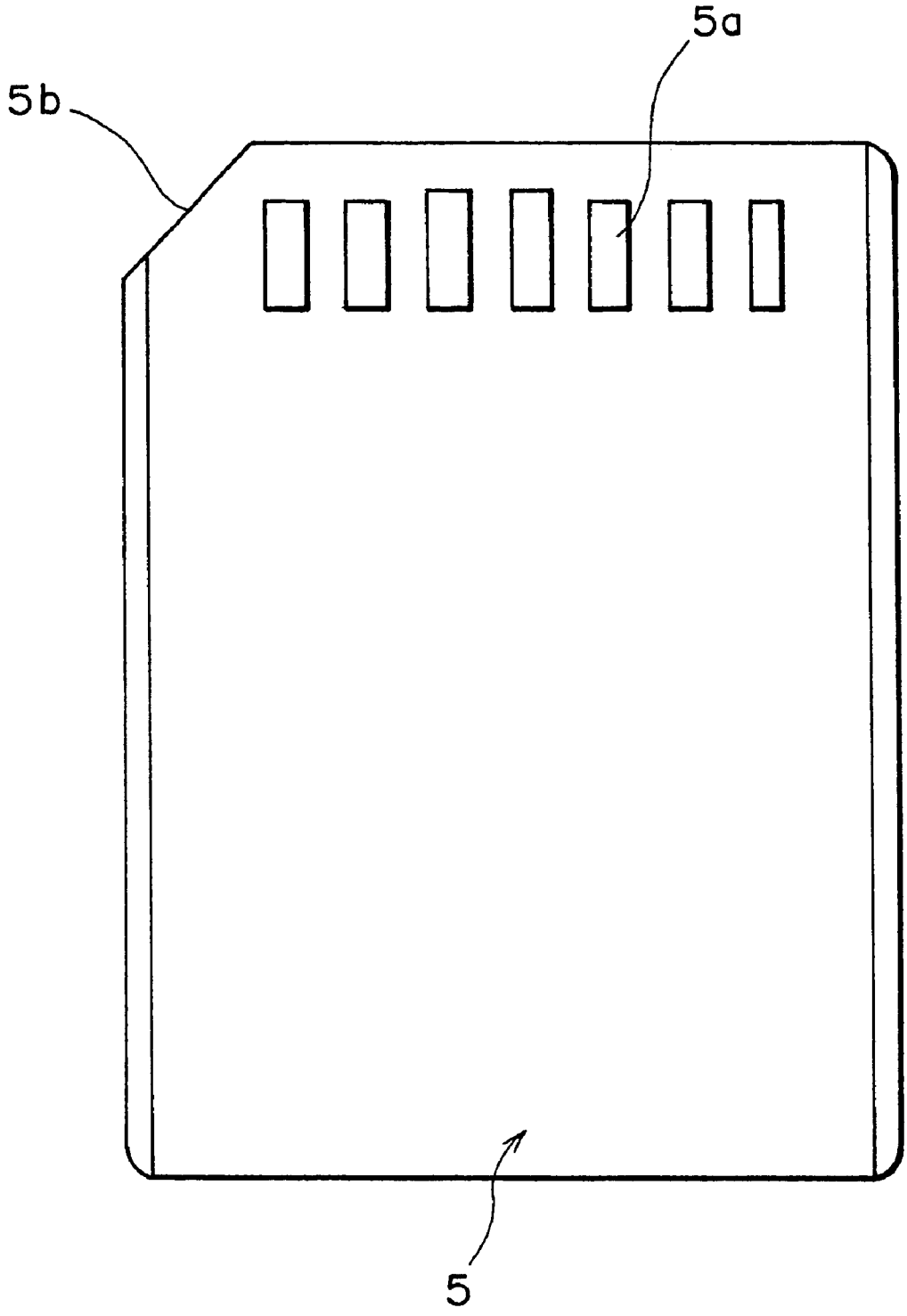
FIG. 5 is a plan view showing an IC card according to an embodiment of the present invention.
Figure 6:
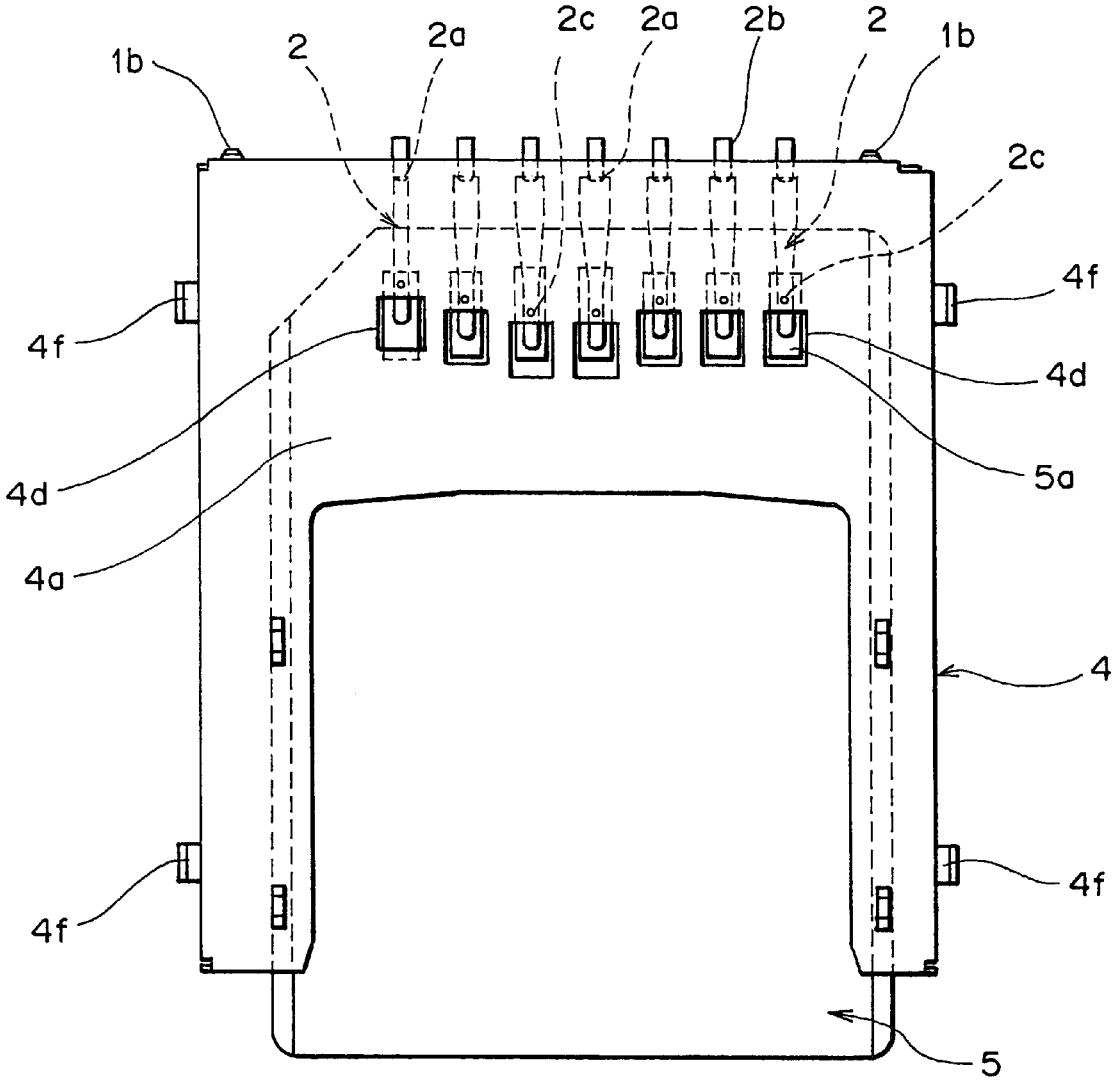
FIG. 6 is a plan view showing a state that the IC card is fitted into the card connector device according to the present invention.
Figure 7:
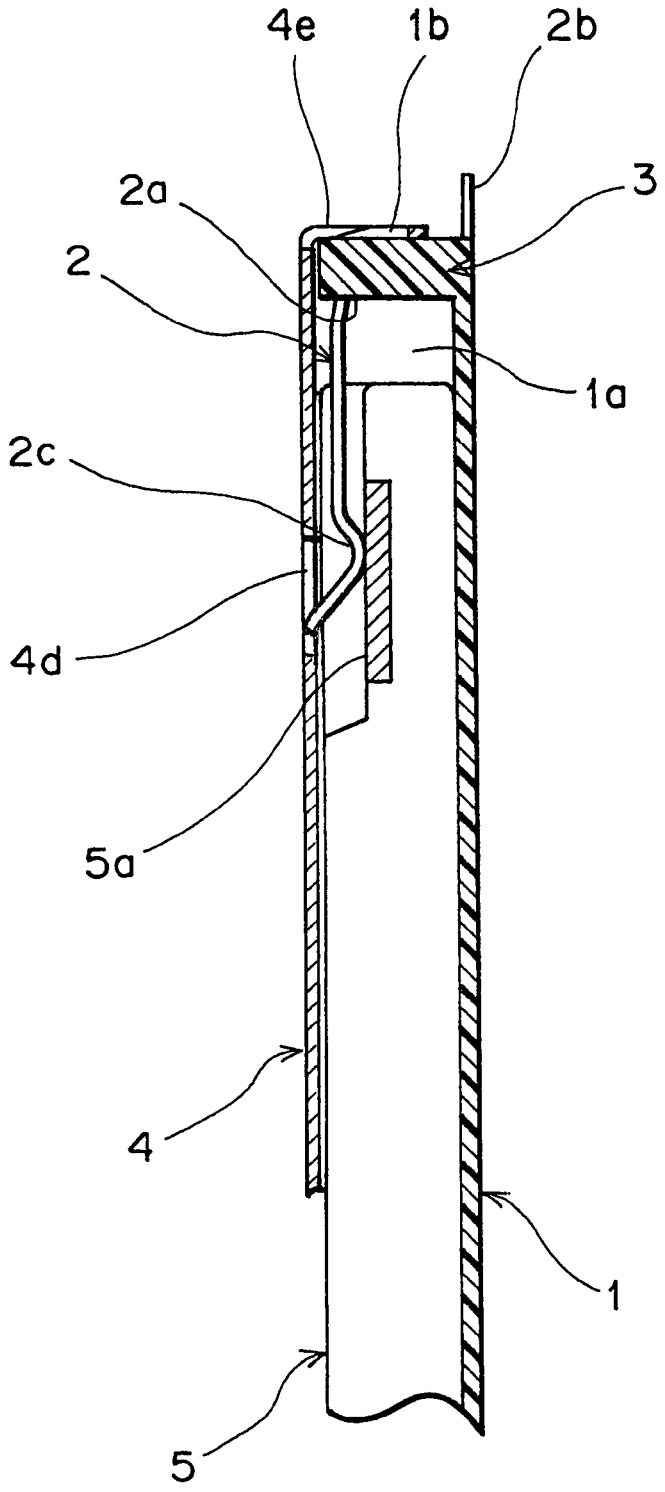
FIG. 7 is a partial cross-sectional view showing a state that the IC card is fitted into the card connector device according to the present invention.
Figure 8:
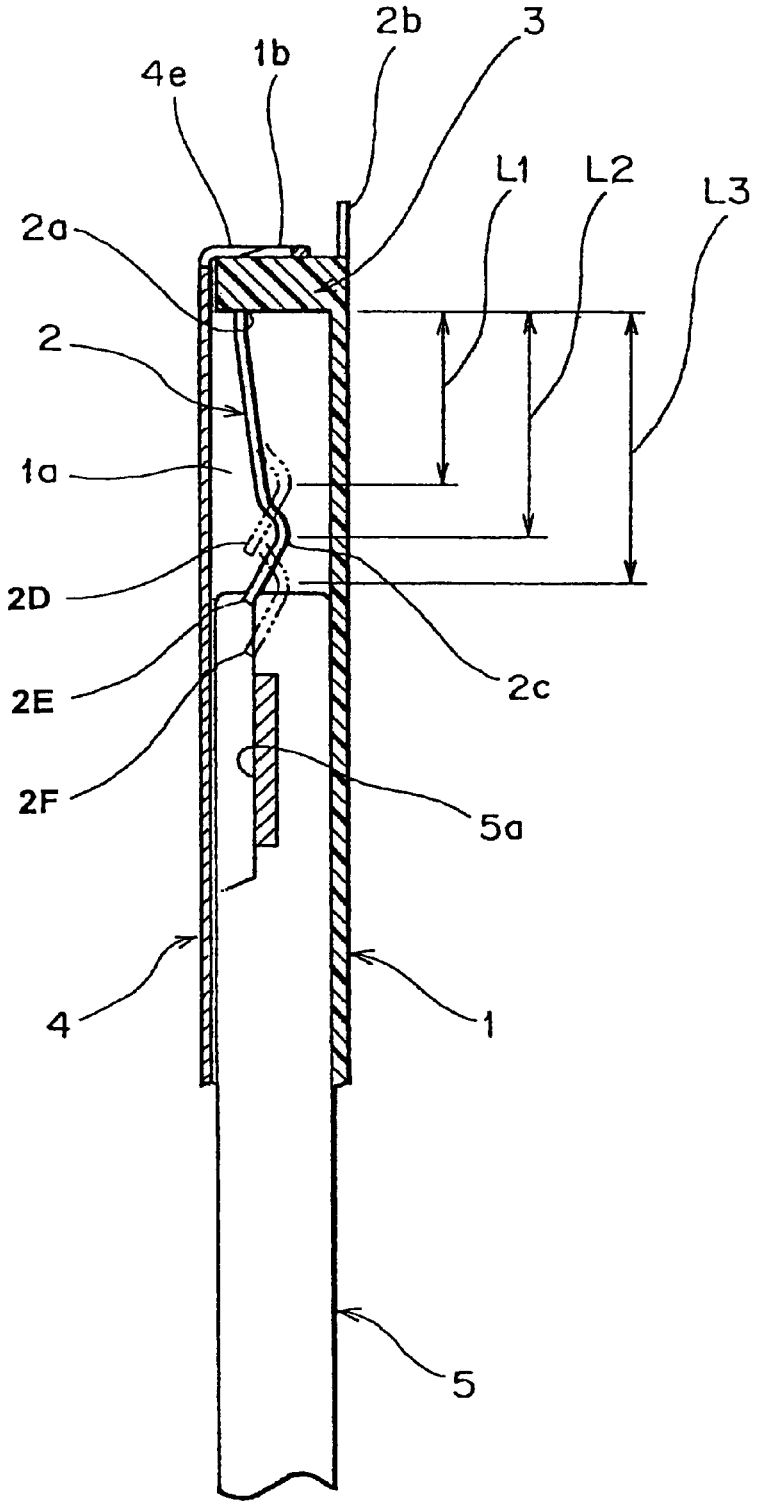
FIG. 8 is a partial cross-sectional view showing an initial state during the IC card is inserted into the card connector device according to the present invention.
Figure 9:
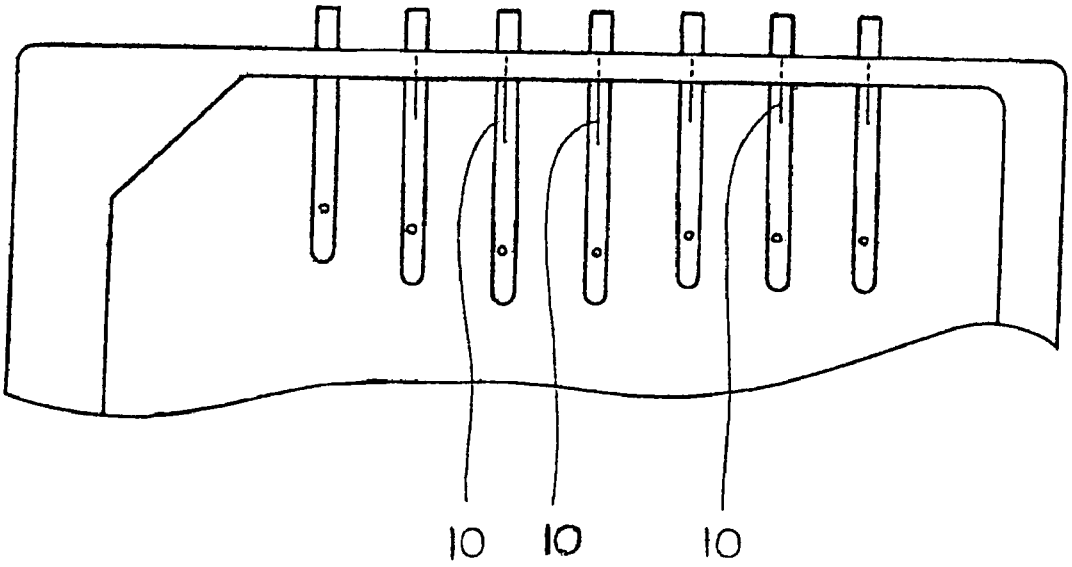
FIG. 9 is a partial view of an embodiment showing reinforcing ribs on contacts of different lengths with the same widths.

Now, an embodiment of the present invention will be explained based on examples with reference to FIGS. 1 to 8. FIG. 1 is a plan view of a card connector device, FIG. 2 is a side view of the card connector device, FIG. 3 is a front view of the card connector device, FIG. 4 is a plan view of a header, FIG. 5 is a plan view of an IC card, FIG. 6 is a plan view showing a set-in state of the IC card, FIG. 7 is a partial cross-sectional view showing the set-in state of the IC card, and FIG. 8 is a cross-sectional view showing an initial inserting state of the IC card.

In the drawings, a frame 1 is made of insulating material such as synthetic resins and the like and is formed in a box shape of which a top surface and a front surface are opened. At the center of the frame 1, a receiving portion 1*a* is formed into which IC card 5, to be described later, is fitted, and at the opposite front end of frame 1, a header 3 is provided for retaining a plurality of connection terminals 2 made of electrically conductive metal plate and placed side by side across the header 3. The header 3 is integrally formed with the frame 1. However, they may be formed separately and engage with each other to form an integral body.

Also, at the opposite front end surface and the side end surface of the frame 1, engagement projections 1*b* for engaging with a cover member 4, to be described later, are formed.

Supporting portions 2*a* are integrally molded in the header 3 by methods such as insert molding and the like to support the connection terminals 2. Also, at one end of the connection terminals 2, solder portions 2*b*, which project from the header 3 toward the outside of the frame 1 to be soldered to circuit patterns of a circuit board installed in electronic equipment and the like (Not Shown), are provided. At the free ends, i.e., the ends opposite the solder portions 2*b*, contact portions 2*c* connect to contacts 5*a* of the IC card 5, to be described later. The solder portions 2*b* and the contact portions 2*c* are electrically connected through the supporting portions 2*a* within the header 3.

Also, as shown in FIG. 4, the connection terminals 2 are supported by the header 3 such that the supporting portions 2*a* are formed side by side on the same straight line having a direction perpendicular to the inserting direction of the IC card 5, while the lengths from the supporting portions 2*a* to the contact portions 2*c* are varied, so that they are suitable for the purposes of the present invention. That is, a connection terminal 2D formed to be shortest (shown as L1) and positioned at the left end side, a connection terminal 2E formed to be intermediate in length (shown as L2) than the connection terminal 2D and a connection terminal 2F formed to be longest (shown as L3) and positioned at the center side are formed.

Also, in the connection terminals 2, the width of the supporting portions 2*a* are suitably formed so that as the lengths from the supporting portions 2*a* to the contact portions 2*c* get longer, rigidity of the supporting portions 2*a* increases and that as the lengths from the supporting portions 2*a* to the contact portions 2*c* provided on the free end side get longer, the widths of the supporting portions 2*a* get wider. That is, a width (W2) of a supporting portion 2Ea of the intermediate length (L2) connection terminal 2E is formed to be wider than a width (W1) of a supporting portion 2Da of the shortest (L1) connection terminal 2D, and is formed to be narrower than a width (W3) of a supporting portion 2Fa of the longest (L3) connection terminal 2F.

By means of the above construction, a connection sequence for the various connection terminals 2 can be obtained with a simple structure. The connecting positions can be set differently when the contacts 5*a* of IC card 5 are connected with the corresponding contact portions 2*c* of the connection terminals 2.

Also, it is not necessary to shift the positions of the supporting portions 2*a* for supporting the connection terminals 2 on the header 3. The lengths of the supporting portions 2*a* of the connection terminals 2 remains constant. Because the widths (W1<W2<W3) of the supporting portions 2*a* are formed wider as the lengths (L1<L2<L3) from the supporting portions 2*a* to the contact portions 2*c* increases, the respective connection terminals 2D, 2E, 2F do not have non-uniform contact pressures due to variations in length. By suitably varying the widths of the supporting portions 2*a*, the contact pressures of the respective contact portions 2Dc, 2Ec, 2Fc can be made uniform and the header 3 can be formed small, thereby accomplishing miniaturization of the connector device.

In the above embodiment, the supporting portions 2*c* are so formed that as the length from the supporting portions 2*a* of the connection terminals 2 to the contact portions 2*c* gets longer, its respective width increases. However, as described above, it is preferable that as the length from the supporting portions 2*a* to the contact portions 2*c* gets longer, rigidity of the supporting portions 2*a* increases. For this purpose, in one embodiment of the present invention, as the length from the supporting portions 2*a* to the contact portions 2*c* increases, the plate thickness of metal material of the connection terminals forming the supporting portions 2*a* the connection terminals 2 becomes thicker. In another embodiment, using the same plate thickness of the metal material, rigidifying reinforcing ribs may be formed on the supporting portions 2*a* by methods such as a press process and the like.

In these embodiments, the width of the supporting portions 2*a* is not changed. If the widths are the same, in order to increase rigidity of the supporting portions 2*a*, when the thickness of metal material plate is changed, the rigidity increases as the plate gets thicker, and when the thickness is the same, the rigidity increases with an increased number of the reinforcing ribs or by enlarging the dimensions of the ribs. These embodiments of the present invention provide the same advantages as the first embodiment described above, wherein the width of supporting portions 2*a* is varied to control rigidity.

The cover member 4 is formed in a U-shape and is made of electrically conductive material and consists of a top plate 4*a* having a flat shape, side plates 4*b* facing each other, and a front plate 4*c*. A plurality of window holes 4*d*is provided in the top plate 4*a*. The free ends of the connection terminals 2 are arranged to face the window holes 4*d*. To obtain deflection of the free ends for adequate elastic force, when the connection terminals 2 are bent by insertion of IC card 5, to be described later, the fronts of the free ends project from the window holes 4*d*.

Also, the cover member 4 is engaged on the frame 1 to cover the receiving portions 1*a* of the frame 1 and the connection terminals 2. In the side plates 4*b* and the front plate 4*c*, engagement holes 4*e* are formed for engaging with the corresponding engagement projections 1*b* provided in the front end surface and the side end surfaces of the frame 1. Also, in the side plates 4*b*, ground terminals 4*f* are provided that electrically shield the IC card and the card connector device when connected to electrical ground patterns of a circuit board installed in electronic equipment and the like (Not Shown).

As shown if FIG. 5, the IC card 5 containing an integrated circuit (IC) is widely used as a recording medium. On one surface side of the IC card 5, a plurality of contacts 5*a* is formed at an end thereof. The contacts 5*a* are received in the receiving portion 1*a* of the frame 1. By electrically contacting the contact portions 2*c* of the plurality of connection terminals 2 arranged in the header 3, various information processing can be carried out with outside electronic equipment connected to terminals 2.

Also, in the IC card 5, a recess portion 5*b* of a sloped surface shape is provided on one corner of IC card 5 nearest the contacts 5*a*. By engaging a slide member (Not Shown) on the recess portion 5*b*, the IC card 5 is fitted into the frame 1 through the slide member and is held in the fitted position by a lock member (Not Shown).

Next, the structure of the connection sequence of the respective connection terminals 2 in the above embodiment will be explained with reference to FIG. 6 to FIG. 8.

First, when the IC card 5 is inserted into the receiving portion 1*a* of the frame 1, because the contacts 5*a* of the IC card 5 are aligned side by side on a straight line perpendicular to the inserting direction of the IC card 5, the corresponding contacts 5*a* are first connected to the longest (L3) connection terminal 2F among the connection terminals 2. In this position, the other contacts 5*a* of the IC card 5 are in a non-connected state.

In this state, because load current such as an inrush current and the like from the connection terminal 2F is designed not to flow to the input side of a microcomputer and the like built in the IC card 5, the destruction of the IC card 5 due to this inrush current can be prevented.

From this state, when the IC card 5 is pressed further in the inserting direction, successive to the connection of terminal 2F, the next longest (L2) connection terminal 2E is connected to corresponding contacts 5*a* in the non-connected state. At that time, since a current is already supplied through the connection terminal 2F to the main circuit portion of the IC card 5, the circuit is in a driving state and a new inrush current is not generated. Because steady and constant current flows on the input side of microcomputer and the like, the concern for destroying the connected IC card 5 has been eliminated.

Also, when the IC card 5 is inserted to the fully fitted position, successive to the connection of terminal 2E, the shortest connection terminal 2D and the last corresponding contacts 5*a* are connected to each other, and the connection of the IC card 5 and the corresponding connection terminals 2 are completed.

In this case, the connection terminals 2 are formed so that the lengths from the supporting portions 2*a* to the contact portions 2*c* are different. As the length from the supporting portion 2*a* to the contact portion 2*c* gets longer, the width of the respective supporting portion 2*a* gets wider, whereby the respective contact pressure of the contact portion 2Dc, 2Ec, 2Fc of the connection terminals 2D, 2E, 2F with corresponding contacts 5*a* is uniform. The connection terminals 2D, 2E, 2F are connected to their respective contacts 5*a* in a stable state with the same contact pressure.

According to the above embodiment, the connection terminals 2 and the corresponding contacts 5*a* of the IC card 5 are connected to each other always in the stable state without having variation of contact pressure. When the contact portions 2*c* of the connection terminals 2 are connected to the corresponding contacts 5*a* of the IC card 5, the connecting position of the contacts 5*a* and the contact portions 2*c* of the connection terminals 2 can be suitably varied and thus a prescribed connection sequence of the IC card can be achieved with a simple structure.

As explained above, the card connector device according to the present invention comprises a header provided with a plurality of side by side connection terminals made of an electrically conductive metal plate and a frame in which the header is arranged at one end thereof and in which a card with a plurality of contacts capable of being connected to the connection terminals is fitted, wherein the connection terminals are provided with supporting portions supported by the header and contact portions elastically contacted with corresponding contacts of the card at free ends extended from the supporting portions, wherein the connection terminals are so formed that the supporting portions are provided side by side on a straight line having a direction perpendicular to a card-inserting direction, and wherein the lengths from the supporting portions to the contact portions vary, and that as the lengths from the supporting portion to the contact portion gets longer, rigidity of the supporting portion increases. Therefore, it does not occur that the contact pressures are non-uniform according to the length of the respective connection terminals, and thus the contact pressures of the respective contact portions can be made the same. The present invention provides a card connector device with a prescribed connection sequence for connection of the IC card.

Also, in one embodiment of the present invention, the connection terminals are so formed that the supporting portions are provided side by side on a straight line having a direction perpendicular to a card-inserting direction, wherein the lengths from the supporting portions to the contact portions vary, and wherein, as the lengths from the supporting portion to the contact portion gets longer, the width of the supporting portion increases. Therefore, like the above, it does not occur that the contact pressures are non-uniform according to the length of the respective connection terminals and thus the contact pressures of the respective contact portions can be made the same. This embodiment of the present invention provides a card connector device with a prescribed connection sequence for connection of the IC card within a simple structure.

Also, the header is arranged at a front end in the card-inserting direction of the frame and the connection terminals are provided with solder portions to be soldered to a circuit board that project from a front side of the header. Therefore, the terminal supporting portions of the connection terminals in the header can be formed small, thereby accomplishing the miniaturization of the whole connector device.

Also, the connection terminals are integrally molded in the header through the supporting portion, and thus it is ensured that the supporting portions are supported by the header, thereby providing a stable pressure on the contact portions.

Also, those skilled in the art will appreciate that various modifications, additions, and substitutions are possible without departing from the scope and spirit of the present invention. Therefore, it should be understood that the present invention is limited only to the accompanying claims and the equivalents thereof, and includes the aforementioned modifications, additions, and substitutions.

What is claimed is:

1. A card connector device, comprising:

a frame into which a card with a plurality of contacts is inserted;

a header formed at one end of said frame having a plurality of side by side connection terminals made of electrically conductive metal plate in a cantilevered state;

wherein said connection terminals are provided with supporting portions supplied by said header and contact portions elastically contacted at free ends extended from said supporting portions with corresponding contacts of said card;

wherein said connection terminals are so formed that said supporting portions are provided side by side on a straight line having a direction perpendicular to a card-inserting direction;

wherein lengths from said supporting portions to said contact portions vary; and wherein as the length from said supporting portion to said contact portion increases, the rigidity of said supporting portion increases in such a way that the contact pressures of said contact portions against said contacts are substantially uniform; and an electrically conductive cover formed to cover said header and part of the card when the card is inserted into said electrically conductive cover with a plurality of window holes, wherein each window hole of the plurality of window holes faces a free end of the free ends of said connection terminals.

2. A card connector device according to claim 1, wherein each of said connection terminals increases a width of said supporting portion as the length from said supporting portion to said contact portion increases to cause the contact pressures of said contact portions against said contacts to be substantially uniform.

3. A card connector device according to claim 2, wherein an end portion of each of said connection terminals opposite to said contact portions becomes a solder portion projected from said header in a forward direction and formed and soldered to a circuit board, wherein said solder portion of the connection terminal having a width of said supporting portion formed wide in correspondence with a length from said supporting portion to said contact portion is made narrower than that of said supporting portion, and wherein spaces between each of said adjoining solder portions are set equal to each other.

4. A card connector device according to claim 1, further comprising solder portions provided on said connection terminals that project from a front side of said header to be soldered to a circuit board.

5. A card connector device according to claim 1, wherein said connection terminals are integrally molded in said header through said supporting portion.

6. A card connector device according to claim 1, wherein as the length from said supporting portion to said contact portion increases, a thickness of said metal plate forming said supporting portion of said connection terminal increases.

7. A card connector device according to claim 1 further comprising reinforcing ribs selectively formed on said supporting portions for increasing the rigidity of said supporting portions.

8. A card connector device according to claim 1, wherein lengths extending from said supporting portions of said respective connection terminals to said contact portions are formed into three types of length, and wherein when said card is inserted and fitted, the connection terminal having the longest length from said supporting portion to said contact portion foremost contacts the contacts of said card as well as the connection terminal having the shortest length from said supporting portion to said contact portion lastly contacts said contacts.

9. A card connector device according to claim 1, wherein lengths extending from said supporting portions of each of said connection terminals to said contact portions are formed into three types of length, wherein in correspondence with this, widths of said respective supporting portions have three types of width, and wherein when said card is inserted and fitted, the connection terminal having the longest length from said supporting portion to said contact portion foremost contacts the contacts of said card as well as the connection terminal having the shortest length from said supporting portion to said contact portion lastly contacts said contacts.

* * * * *

UNITED STATES PATENT AND TRADEMARK OFFICE

CERTIFICATE OF CORRECTION

PATENT NO. : 6,558,199 B2
DATED : May 6, 2003
INVENTOR(S) : Oguchi

It is certified that error appears in the above-identified patent and that said Letters Patent is hereby corrected as shown below:

Column 7,
Line 10, "supplied" should read -- supported --.

Signed and Sealed this

Ninth Day of December, 2003

JAMES E. ROGAN
*Director of the United States Patent and Trademark Office*